US009494383B2

(12) United States Patent
Kharlampov

(10) Patent No.: US 9,494,383 B2
(45) Date of Patent: Nov. 15, 2016

(54) TACTICAL GUN SLING

(71) Applicant: Vladimir Vladimirovich Kharlampov, Moscow (RU)

(72) Inventor: Vladimir Vladimirovich Kharlampov, Moscow (RU)

( * ) Notice: Subject to any disclaimer, the term of this patent is extended or adjusted under 35 U.S.C. 154(b) by 0 days.

(21) Appl. No.: 14/397,411

(22) PCT Filed: Feb. 12, 2013

(86) PCT No.: PCT/RU2013/000102

§ 371 (c)(1),
(2) Date: Oct. 27, 2014

(87) PCT Pub. No.: WO2013/180596

PCT Pub. Date: Dec. 5, 2013

(65) Prior Publication Data

US 2015/0083763 A1 Mar. 26, 2015

(30) Foreign Application Priority Data

Apr. 27, 2012 (RU) ..... 2012117403

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01); *F41C 33/001* (2013.01)

(58) Field of Classification Search
CPC ..... F41C 33/022; F41C 23/02; F41C 33/001; Y10S 224/913; A45F 3/14
(Continued)

(56) References Cited

U.S. PATENT DOCUMENTS 1,186,496 A * 6/1916 Randall ..... 224/150
1,210,475 A * 1/1917 Hooper ..... 224/150
(Continued)

FOREIGN PATENT DOCUMENTS

RU 92166 U1 3/2010
RU 2421675 C1 6/2011
SU 1740966 A1 6/1992

OTHER PUBLICATIONS

International Search Report and Written Opinion dated Oct. 31, 2013 for corresponding International Patent Application No. PCT/RU2013/000102, filed Feb. 12, 2013.
(Continued)

*Primary Examiner* — Justin Larson
*Assistant Examiner* — Lester L Vanterpool
(74) *Attorney, Agent, or Firm* — David D. Brush; Westman, Champlin & Koehler, P.A.

(57) ABSTRACT

A tactical gun sling includes a length-adjustable sling in a form of a loop, a front sling mount, a quick-release element for fixing to the gun barrel unit and an element for fixing to the gun butt, or an element for fixing to the rear sling mount on the receiver, a sling adjustment unit, and an adjustment strap which passes through the sling adjustment unit. One end of the sling is fixed through the quick-release element to the front sling mount and the other end is left free. The sling additionally includes a quick adjustment unit through which the sling passes in a form of a loop. The gun sling enables adjustment of the length of the sling quickly and provides a large adjustment margin of the basic loop, which makes it possible to transform and use the sling on nearly any type of personal small arms.

9 Claims, 1 Drawing Sheet

(58) Field of Classification Search
USPC ..... 224/150, 149
See application file for complete search history.

(56) References Cited

U.S. PATENT DOCUMENTS

| | | | | |
|---|---|---|---|---|
| 1,292,875 | A * | 1/1919 | Randall | F41C 33/002 224/150 |
| 1,332,088 | A * | 2/1920 | Wagner | F41C 23/02 224/150 |
| 2,446,197 | A * | 8/1948 | Sloan | F41C 33/001 224/150 |
| 3,441,185 | A * | 4/1969 | Moomaw | F41C 33/001 224/150 |
| 3,495,770 | A * | 2/1970 | Seltmann, Jr. et al. | F41C 33/002 224/150 |
| 3,595,451 | A * | 7/1971 | Branby | 224/150 |
| 4,249,686 | A * | 2/1981 | Morwood | F41C 33/002 224/150 |
| 4,511,070 | A * | 4/1985 | Hightower | 224/150 |
| 5,660,312 | A | 8/1997 | Suzuki | |
| 5,810,219 | A * | 9/1998 | Rosenfield | 224/150 |
| 6,068,167 | A * | 5/2000 | Hopson | 224/150 |
| 6,325,258 | B1 * | 12/2001 | Verdugo | F41C 33/001 224/149 |
| 6,932,254 | B2 * | 8/2005 | Eliason | 224/150 |
| 7,059,502 | B2 | 6/2006 | Johnson | |
| 7,069,624 | B2 * | 7/2006 | Johnson | 24/302 |
| 2004/0159687 | A1 * | 8/2004 | Eliason | A45F 3/14 224/150 |
| 2004/0182894 | A1 * | 9/2004 | Johnson | 224/150 |
| 2004/0188476 | A1 * | 9/2004 | Johnson | 224/150 |
| 2006/0208016 | A1 * | 9/2006 | Esch | 224/150 |
| 2007/0028262 | A1 | 2/2007 | Bucher et al. | |
| 2007/0278262 | A1 * | 12/2007 | Gallagher | F41C 23/02 224/150 |
| 2008/0217371 | A1 * | 9/2008 | Wemmer | F41C 33/00 224/579 |
| 2008/0302838 | A1 * | 12/2008 | Burnsed, Jr. | F41C 23/02 224/150 |
| 2014/0203053 | A1 * | 7/2014 | Rivas-Schlanger | F41C 33/002 224/150 |

OTHER PUBLICATIONS

International Preliminary Report on Patentability and Written Opinion dated Oct. 28, 2014 for corresponding International Patent Application No. PCT/RU2013/000102, filed Feb. 12, 2013.

* cited by examiner

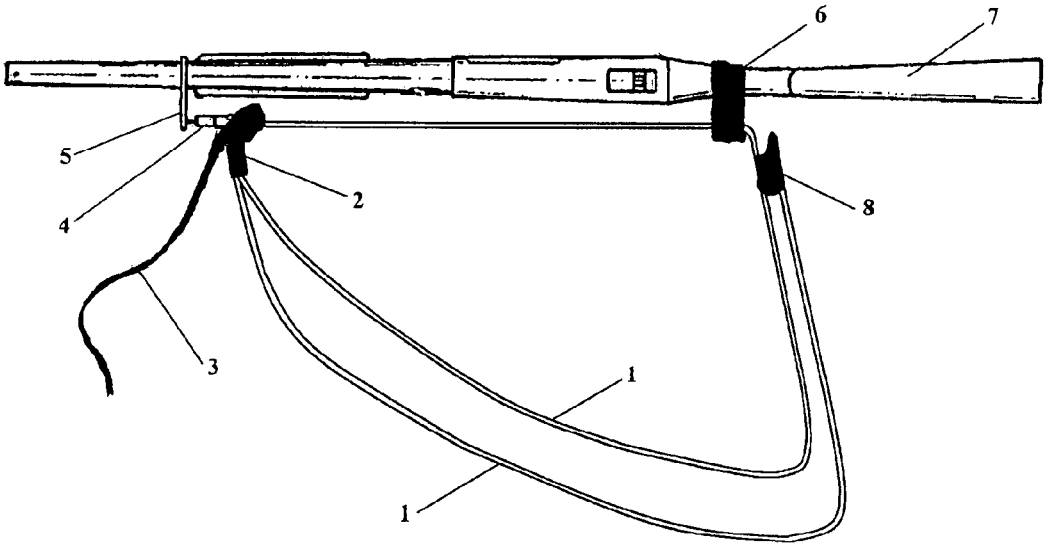
6
7
5
4
2
8
3
1
1

TACTICAL GUN SLING

CROSS-REFERENCE TO RELATED APPLICATIONS

This Application is a Section 371 National Stage Application of International Application No. PCT/RU2013/000102, filed Feb. 12, 2013, the content of which is incorporated herein by reference in its entirety, and published as WO 2013/180596 on Dec. 5, 2013, not in English.

FIELD OF THE DISCLOSURE

The present invention relates to weapon technology and specifically to gun slings used by special forces.

BACKGROUND OF THE DISCLOSURE

The operations of special forces, which include combat at close range directly in a city and firing contact at small and ultra-small distances, require special types of guns, new methods of handling those, as well as special equipment. Such equipment also includes tactical gun slings allowing quick and easy gun handling.

Several types of tactical gun slings distinguished by the type of fixation to a firearm are currently known.

They include, for example, the tactical single-point sling, which is fixed to a gun at single point, usually on the butt of the gun. The single-point gun sling comprises a sling designed in the form of a length-adjustable loop and having an element for fixing to the gun (see. US Application No. US 2006/0208016, IPC F41C 23/02, 2006).

The main feature of the prior-art tactical sling is that it ensures maximum freedom for the gun. The gun is easily directed in any direction, can be fitted into the silhouette of the operator when passing through doorways and other narrow places, and can be easily moved from one shoulder to the other.

The main drawback of such a gun sling is the large amplitude of swinging of the gun in the free position. To overcome this drawback it is necessary to install special clamps what greatly complicates a design.

The most popular sling at present time is a two-point gun sling comprising a length-adjustable sling having at its ends elements for fixing to the gun (see. US Application No. US 2004/0188476, IPC F41C 23/02, 2004). The two-point gun sling enables the operator to quickly and easily adjust the length of the sling. By pulling one end of the sling, it is possible to change the length of the sling quickly so that the gun moves directly close to body, and vice versa, to restore its original length.

The drawback of such gun sling is that its design does not allow the operator to perform the movement of the gun to the other shoulder without changing position of the sling system on his body in process or without taking off the said sling system from his body at all.

The most perfect tactical gun sling is currently the three-point gun sling made of a length-adjustable sling in the form of a loop and having two elements for fixing to a gun and a third fixing element, which is used when moving the gun from one position into another. This element is mounted in such manner that it is able to move along the sling (see. US Application No. US 2007/0278262, IPC F41 C 23/02, 2007). This sling is intended for comfortable transportation of a gun. The design of such sling enables it to take a fixed position on the operator's body, and the design makes it possible to toss up a gun from any position, i.e., it is most balanced, according to the requirements to a gun sling system and it is one of the most popular among professional soldiers of special forces.

However, this design does not provide necessary comfort and freedom of action because a tight fit of a personal gun to body is impossible, and excessive adjustment of sling length makes it very difficult to fire the gun even when this sling system is actually transformed into a single-point system.

The gun sling that is most close in terms of design and principle of action is a gun sling comprising a length-adjustable sling in form of a loop, front sling mount, a quick-release element for fixing to a gun barrel unit and an element for fixing to butt of a gun, a sling adjustment unit, an adjustment strap passing through the sling adjustment unit, one end of which is fixed through the quick-release element to the front sling mount, and the second one remains free, while movement limiters are mounted close to the sling adjustment unit to limit the movement of said sling adjustment unit in both directions (see. Russian Patent No. RU2421675 for invention, "DOLG m2™ tactical gun sling," IPC F41C 23/02, publication date Jun. 20, 2011).

This sling design makes it possible to increase comfort and freedom of action when moving the gun and using it.

Its drawback is that it does not make it possible to adjust sling length quickly due to rather small margin for adjusting the basic loop, and the limited possibility of transforming and using the gun.

SUMMARY

The technical effect of the present invention is that quick adjustment of the length of the sling is ensured, the margin for adjusting the basic loop is increased, and new possibilities are offered for transforming and using the sling.

This technical effect is accomplished by the fact that the gun sling comprises a length-adjustable sling in a form of a loop, a front sling mount, a quick-release element for fixing to the gun barrel unit and an element for fixing to the butt of the gun, and a sling adjustment unit. What is novel is that the sling additionally comprises a quick adjustment unit, through which the sling passes in the form of a loop.

BRIEF DESCRIPTION OF THE DRAWING

The present invention is explained by the drawing, which schematically shows a general view of the gun sling installed on the gun.

DETAILED DESCRIPTION OF ILLUSTRATIVE EMBODIMENTS

The gun sling comprises a sling 1 in a form of a loop, which passes through the adjustment unit 2, an adjustment strap 3 passed through the adjustment unit 2 and connected by one end to the front sling mount 5 through the fixing element 4, while its other end remains free, and sling 1 further passes freely through a rear sling mount 6 for fixing to the head part of the butt 7, an additional quick adjustment unit 8, through which the sling 1 also passes, forming a second loop.

The gun sling operates as follows.

In the initial state, the sling 1, passing through the adjustment units 2 and 8, forms two loops, which are put on the shoulders, like the straps of a backpack, and bring about the transfer of the gun onto the back according to the "biathlon" method. To use the sling on sniper rifles, the two loops of the sling 1 are put together, which transforms the sling into a two-point sling. The transformation from the "biathlon" variant into the two-point variant and vice versa without increasing the length of the sling is accomplished now without additional manipulations with the adjustment unit 8 of the basic loop of the sling. If it is necessary to increase the length of the sling, the adjustment strap 3 is pulled out through the unit 2 and so is the sling 1 through the quick adjustment unit 8. In order to set the "transport position," the "combat position" and the "patrol position," the gun is placed in advance in front of or behind the operator, putting the sling 1 over the neck and the shoulder. The free end of the adjustment strap 3 is pulled out completely in the "transport position" and the adjustment unit 2 is pulled now up to the fixing element 4, and the gun assumes a diagonal position, being closely in contact with the operator's uniform. In "patrol position" the adjustment strap 3 is pulled out through the adjustment unit 2 over a length comfortable for the operator. In the "combat position" the adjustment strap 3 is pulled out almost completely, the gun is freed, which makes it possible to fire with the butt from both the right shoulder and the left shoulder. To increase the length of the sling, the sling 1 is pulled out through the quick adjustment unit 8 in all these positions.

Thus presence of the quick adjustment unit 8 makes it possible to adjust length of the sling very quickly and to provide a rather large margin for adjusting the basic loop, which makes it possible to transform the sling into two straps, analogous to the straps of a backpack, and to bring about the transfer of the gun according to the "biathlon" method (on the back, after putting on the straps of the sling over both shoulders); to put the straps together, which transforms the sling into a two-point sling with the adjustment strap. Such a function is extremely useful for using the sling on sniper rifles. The transformation from the "biathlon" variant into the two-point variant and vice versa is accomplished very quickly and without additional manipulations with the adjustment unit of the basic loop of the sling, which ensures, on the whole, a great tactical advantage.

The sling can be used effectively in practically any type of personal small arm, offering functional and tactical advantages for each type in particular, starting from submachine guns, continuing with automatic rifles, sniper rifles, shotguns, machine guns and manual grenade launchers.

The invention claimed is:

1. A tactical gun sling, comprising:

a front sling mount;

a quick-release element connected to the front sling mount;

a rear sling mount configured to fix to a receiver or a butt of a gun;

a first sling adjustment unit;

a second sling adjustment unit;

an adjustment strap, which passes through the first sling adjustment unit and has a first end that is fixed through the quick-release element to the front sling mount and a second, free end that remains free, wherein a position of the first adjustment unit relative to the front sling mount is adjustable by pulling on the free end;

a length-adjustable sling in the form of a loop, which is fixed to the first sling adjustment unit, passes freely through the rear sling mount, passes through the second sling adjustment unit and passes a second time through the first sling adjustment unit and is fixed to the second sling adjustment unit.

2. The tactical gun sling of claim 1, wherein the length-adjustable sling comprises a length, which:

extends along a first portion from the first adjustment unit to the rear sling mount, passes freely through the rear sling mount, extends along a second portion from the rear sling mount to the second adjustment unit, passes through the second adjustment unit, extends along a third portion from the second adjustment unit to the first adjustment unit, passes through the first adjustment unit, and extends along a fourth portion from the first adjustment unit back to the second adjustment unit.

3. The tactical gun sling of claim 2, wherein the loop formed by the length-adjustable sling comprises first and second loops, wherein:

the first loop is formed by the first, second and third portions of the length adjustable sling; and the second loop is formed by the third and fourth portions of the length-adjustable sling.

4. The tactical gun sling of claim 3, wherein the second adjustment unit adjusts a length of the first and second loops simultaneously.

5. The tactical gun sling of claim 2, wherein adjustment of the adjustment strap through the first adjustment unit adjusts the first and second portions of the length adjustable sling simultaneously.

6. A tactical gun sling, comprising:

a front sling mount;

a quick-release element connected to the front sling mount;

a rear sling mount configured to fix to a receiver or a butt of a gun;

a first sling adjustment unit;

a second sling adjustment unit;

an adjustment strap, which passes through the first sling adjustment unit and has a first end that is fixed through the quick-release element to the front sling mount and a second, free end that remains free, wherein a position of the first adjustment unit relative to the front sling mount is adjustable by pulling on the free end;

a length-adjustable sling in the form of a loop, which passes through the first sling adjustment unit, the second sling adjustment unit and the rear sling mount and comprises a length having first, second, third and fourth portions, and wherein the length:

has a first end that is fixed to the first adjustment unit, extends along the first portion from the first adjustment unit to the rear sling mount, passes freely through the rear sling mount, extends along the second portion from the rear sling mount to the second adjustment unit, passes through the second adjustment unit, such that the second adjustment unit is slidable along the length so as to adjust lengths of both the second portion and the third portion, extends along the third portion from the second adjustment unit to the first adjustment unit, passes through the first adjustment unit, and extends along the fourth portion from the first adjustment unit back to the second adjustment unit and has a second end fixed to the second adjustment unit, wherein the first, second, third and fourth portions of the length are adjustable, and wherein adjustment of the adjustment strap though the first adjustment unit adjusts the first and second portions of the loop simultaneously.

7. The tactical gun sling according to claim 1, wherein the loop has a length and:

the length is passable through the first sling adjustment unit and the second sling adjustment unit to form first and second loops for putting on the shoulders of a user in a first state; and the first and second loops of the sling in the first state are placeable together in a second state.

8. The tactical gun sling according to claim 1, wherein a length of the sling is adjustable by pulling the adjustment strap through the sling first sling adjustment unit and pulling the length-adjustable sling through the second sling adjustment unit.

9. The tactical gun sling according to claim 1, wherein the tactical gun sling is configurable in a transport position, a patrol position, and a combat position, such that:

in the transport position the free end of the adjustment strap is pulled out completely and the first sling adjustment unit is pulled up to the quick release element, while the first end of the adjustment strap is connected to the front sling mount through the quick release element;

in the patrol position the adjustment strap is pulled out through the first sling adjustment unit over a length; and in the combat position the adjustment strap is pulled out almost completely to free the gun such that the gun is fireable with the butt in the user's right or left shoulder.

* * * * *